US012258776B2

(12) United States Patent
Naylor

(10) Patent No.: US 12,258,776 B2
(45) Date of Patent: Mar. 25, 2025

(54) FENCE-POST SYSTEM AND METHODS RELATING THERETO

(71) Applicant: BJA TRADING LTD, High Wycombe (GB)

(72) Inventor: Mark Anthony Naylor, Latchford (GB)

(73) Assignee: BJA TRADING LTD, High Wycombe (GB)

( * ) Notice: Subject to any disclaimer, the term of this patent is extended or adjusted under 35 U.S.C. 154(b) by 260 days.

(21) Appl. No.: 17/596,195

(22) PCT Filed: Jun. 3, 2020

(86) PCT No.: PCT/GB2020/051337
§ 371 (c)(1),
(2) Date: Dec. 3, 2021

(87) PCT Pub. No.: WO2020/245580
PCT Pub. Date: Dec. 10, 2020

(65) Prior Publication Data

US 2022/0220767 A1 Jul. 14, 2022

(30) Foreign Application Priority Data

Jun. 5, 2019 (GB) ..... 1908039

(51) Int. Cl.
*E04H 17/20* (2006.01)

(52) U.S. Cl.
CPC ..... *E04H 17/20* (2013.01)

(58) Field of Classification Search
None
See application file for complete search history.

(56) References Cited

U.S. PATENT DOCUMENTS 991,603 A * 5/1911 Brooks ..... E04C 3/07 52/364
4,193,584 A 3/1980 Wieser
(Continued)

FOREIGN PATENT DOCUMENTS

AU 2013101690 A4 5/2014
CA 2806405 A1 8/2013
(Continued)

OTHER PUBLICATIONS

United Kingdom Intellectual Property Office, Examination Report issued Nov. 29, 2022 regarding Application No. GB2011765.1, 3 pages.
(Continued)

*Primary Examiner* — Matthew R McMahon

(57) ABSTRACT

A fence-post system (10) comprising a first fence post (12) and a second fence post (14). The first and second fence posts (12, 14) are formed from folded sheets of metal of different thicknesses and have different front flange widths (FW1, FW2). A first fence post (12) has a wider front flange width (FW1) and a narrower thickness (T1) than the second fence post (14). The difference in material provided by the difference in the front flange width (FW1) equates or substantially equates to the difference in material provided by the thickness. Thus, the linear mass densities of the fence posts (12, 14) are similar or identical.

19 Claims, 5 Drawing Sheets

(56) References Cited

U.S. PATENT DOCUMENTS

| | | | | |
|---|---|---|---|---|
| 4,455,806 | A * | 6/1984 | Rice | E04C 3/07 52/404.1 |
| 4,852,325 | A * | 8/1989 | Dunn | E04C 3/07 52/506.07 |
| 6,138,416 | A * | 10/2000 | Platt | E04B 9/006 52/28 |
| 6,745,537 | B1 | 6/2004 | Hamilton | |
| 6,874,765 | B2 * | 4/2005 | Deeley | E04H 17/143 256/59 |
| 10,221,529 | B1 * | 3/2019 | Sanders | H02G 3/386 |
| 10,604,962 | B1 * | 3/2020 | Givens | E04H 17/163 |
| 11,408,196 | B2 * | 8/2022 | Cogburn | E04H 17/1447 |
| 2005/0116212 | A1 | 6/2005 | Deeley | |
| 2008/0163569 | A1 | 7/2008 | Woodard | |

FOREIGN PATENT DOCUMENTS

| | | | |
|---|---|---|---|
| FR | 2872191 | A3 | 12/2005 |
| GB | 1544915 | A | 4/1979 |
| GB | 2130618 | A | 6/1984 |
| GB | 2248643 | A | 4/1992 |
| GB | 2464760 | A | 5/2010 |
| GB | 2536312 | A | 9/2016 |
| GB | 2570964 | A | 8/2019 |

OTHER PUBLICATIONS

United Kingdom Intellectual Property Office, Search Report under Section 17 regarding Application No. GB1908039.9, dated Oct. 16, 2019, 2 pages.

United Kingdom Intellectual Property Office, Further Search Report under Section 17 regarding Application No. GB1908039.9, dated Dec. 19, 2019, 2 pages.

United Kingdom Intellectual Property Office, Examination Report under Section 18(3) regarding Application No. GB 1908039.9, dated Feb. 12, 2020, 5 pages.

International Search Report and Written Opinion of the International Searching Authority issued Nov. 18, 2020 regarding Application No. PCT/GB2020/051337, 16 pages.

United Kingdom Intellectual Property Office, Search Report under Section 17 regarding Application No. GB20117651.1, dated Oct. 2, 2020, 1 page.

* cited by examiner (a)

(b)

(a)

(b)

(a)

(b)

FENCE-POST SYSTEM AND METHODS RELATING THERETO

CROSS REFERENCE TO RELATED APPLICATIONS

This application is a 371 National Stage of International Application No. PCT/GB2020/051337, filed Jun. 3, 2020, which claims priority to United Kingdom Patent Application No. GB1908039.9, filed Jun. 5, 2019, the disclosures of which are herein incorporated by reference in their entirety.

BACKGROUND

The present invention relates to a fence-post system, a method of forming a fence post system, a method of conforming handling and/or transport weight for fence posts and a method of erecting a fence post.

Fences are used to provide barriers between areas and are typically supported by fence posts. Fence posts have different applications and therefore have different structural or aesthetic requirements.

For example, in a given application it may be desirable for a fence post's visual impact to be minimized. A thin fence post type may therefore be required for this application.

Alternatively, in a different application, a fence post with a greater overlap or engagement with adjacent fence panels may be required to ensure greater retention between the fence panels and the fence post. This may be because a resulting fence is required to withstand a greater maximum windspeed. Additionally, a greater post-panel overlap may reassure users that the fence is durably constructed. A wide fence post type may therefore be required for this application.

For a manufacturer of fence posts, different fence post types each require different quantities of raw material. Therefore, different fence post types have different associated costs. This therefore requires more complex supply and pricing structures for the manufacturer.

For a distributer of fence posts, different fence post types, having different amounts of material, typically have different weights and may have different shapes. This can create complexities in the transportation and storage of the fence posts.

For an installer of fence posts, it can be required to have different fence post types installed within the same fence or in a different fence on the same site. The different weights of the different fence post types can be inconvenient for the installers as they must therefore be aware of the different lifting requirements for each fence post type. If such lifting requirements are ignored, then this poses health and safety problems.

The present invention seeks to provide a solution to these problems.

SUMMARY

According to a first aspect of the invention there is provided a fence-post system which comprises a first fence post including a first front flange having a first front width and a first rear flange, the first fence post formed from a folded sheet having a first thickness of a first material; and a second fence post including a second front flange having a second front width and a second rear flange, the second fence post formed from a folded sheet having a second thickness of a second material; wherein the first and second materials have a similar or identical density, the first front width is greater than the second front width, and the second thickness is greater than the first thickness such that a linear mass density of the first and second fence posts is the same or substantially the same.

First and second fence posts with different front widths creates two different fence post types which are suited to different requirements. For example, if the fence post is to be installed in a fence where minimization of the visual impact of the fence post is important, the second fence post with a narrower front flange and a greater rear width to front width ratio may be selected. However, if strength of attachment between the fence post and the fence panel is of significant importance, for example if the fence is required to withstand very high windspeeds, then the first fence post may be selected. The wider front flange and/or smaller front flange width to rear flange width ratio ensures a stronger force of attachment with the fence panel.

Given their identical or similar linear mass density, a given length of the fence posts has the same or substantially the same weight. Thus, manufacturing costs, manufacturing supply-chain, arrangement of the transportation of the posts, and lifting provisions during installation are simplified.

A front flange may be regarded as a flange that in use forms part of a surface of the fence that is viewed most frequently and/or is most aesthetically important. Conversely a rear flange is a flange that in use forms part of a surface of the fence that is viewed less frequently and/or is less aesthetically important. The front and rear flanges may otherwise be termed as primary or secondary flanges respectively, or initial and further flanges respectively.

Preferably, said first thickness may be between 1.2 mm and 1.8 mm, for example 1.5 mm, and said second thickness may be between 1.7 mm and 2.3 mm, for example 2 mm, provided that the second thickness is greater than the first thickness.

Alternatively, said first thickness may be between 1.7 mm and 2.3 mm, for example 2 mm, and said second thickness may be between 2.2 mm and 2.8 mm, for example 2.5 mm, provided that the second thickness is greater than the first thickness.

Beneficially, the first front width may be between 50 mm and 80 mm, for example 64 mm, and the second front width may be between 10 mm and 50 mm, for example 30 mm.

Optionally, the first front width may be between 40 mm and 60 mm, for example being 48 mm, and the second front width may be between 10 mm and 30 mm, for example 20 mm.

Advantageously, a plurality of fastener-receiving apertures extends through at least one of the first front or rear flanges and at least one of the second front or rear flanges. Fastener receiving apertures allow for fence panels to be attached to the fence post via screws or bolts.

Additionally, the plurality of fastener-receiving apertures may be linearly arranged and include a plurality of circular holes and a plurality of elongate slots, adjacent slots being separated by at least one circular hole. Slots can allow for a greater tolerance of positioning of the fence post relative to the fence panel. Providing slots separated by regular numbers of holes can help to provide a marker or identifier for assisting in installation.

Preferably, the first rear flange may have a first rear width and the second rear flange may have a second rear width, the first and second front widths being less than the first and second rear widths respectively. Having one flange narrower than the other flange reduces the amount of material used in formation of the fence post and therefore reduces the weight and cost of production of the fence post. However, having at least one wider flange can assist with preventing or limiting the fence panel from being pivoted out of the channel between the flanges. Thus, a wider and narrower flange provides a more efficient construction.

Advantageously, the first and second rear widths may be similar or identical to each other, and the first and second front widths may be different to each other. This allows a user to select from fence posts which have a similar fence panel retention or pivot prevention characteristic, but with different front flange widths.

Beneficially, a first ratio of the first rear width to the first front width may be between 1:1 and 1.4:1, for example 1.1:1, and a second ratio of the first rear width to the first front width may be between 2.4:1 and 2.8:1, for example 2.5:1 or 2.7:1.

In a preferable embodiment, the first fence post may further comprise a first central web which extends between the first rear flange and the first front flange, the first central web and one of the first rear or front flange comprising two layers of material, and the second fence post may further comprise a second central web which extends between the second rear flange and the second front flange, the second central web and one of the second rear or front flange comprising two layers of material. A central web or rib allows for two channels to be defined between the front and rear fence posts. A double layer of material for the central web provides a greater strength and a greater torsional strength to the fence.

Additionally, the two layers of material of the central web and/or said one of the rear or front flange of each fence post may abut or substantially abut each other. Abutment or abutting engagement of the two layers may help to prevent bending or other deformation of the layers of the central web. Additionally, corrosion of the inside surfaces of the double layers may be prevented or limited.

Preferably, the first and second front flanges are double layered. A narrower front flange may limit the structural performance of the fence post. Therefore, a thicker front flange can compensate and/or provide additional strength to the front flange in this instance.

Additionally, the first and second rear flanges are single layered. A single layer of the front flange, which may be wider than the rear flange, can reduce the total amount of material used to form the fence post and therefore the cost and weight more effectively.

Optionally, the material may be steel. Steel is a strong, durable and rigid material. A lower mass of steel can therefore be used to achieve a given structural requirement than, for example, concrete.

Beneficially, each fence post may be formed via cold-rolling such that the material may be cold-rolled steel. Roll forming is a continuous formation method and therefore it is suitable and cost effective for fence posts which have a uniform cross-section. Cold-rolling rather than hot-rolling improves the hardness and strength of the fence post.

In a preferable embodiment, the first and second fence posts may have similar or identical lengths. Similar or identical lengths results in a similar or identical weight of the fence posts.

Optionally, a length of the first and second fence posts may be between 2.5 m and 3.5 m, for example and the mass of each of the first and second fence posts is between 12 kg and 18 kg, for example 15 kg.

Alternatively, a length of the fence post may be between 2 m and 3 m, for example 2.4 m, and the mass of each of the first and second fence posts is between 5 kg and 9 kg, for example 7 kg.

It will be appreciated that the fence posts are preferably each unitarily formed as a one piece, preferably with the exception of the fastener receiving apertures. In other words, the fence posts do not comprise a plurality of sub-assemblies.

According to a second aspect of the present invention there is provided a method of forming a fence post system preferably according to the first aspect of the invention, the method comprising: a) selecting a first sheet of first material having a first thickness and a first sheet width, and a second sheet of second material having a second thickness and a second sheet width, the first and second materials having similar or identical densities, the first sheet width being greater than the second sheet width, and the second thickness being greater than the first thickness such that a linear mass density of the first and second sheets is the same or substantially the same; b) folding the first and second sheets into first and second fence posts respectively, the first fence post including a first front flange having a first front width and a first rear flange and the second fence post including a second front flange having a second front width and a second rear flange.

According to a third aspect of the present invention there is provided a method of conforming handling and/or transport weight for fence posts with different lateral cross-sections using a fence-post system preferably according to a first aspect of the invention, the method comprising the step of forming first and second fence posts from similar or identical materials, the first and second fence posts having similar or identical linear mass densities and different cross-sections.

According to a fourth aspect of the present invention there is provided a method of erecting a fence post, the method comprising the steps of: a) providing a supply of fence posts adapted to be embedded into the ground at one end, the fence posts being formed from folded sheets of material so as to have both different lateral cross-sections and matching or substantially matching linear mass densities; b) identifying an installation site of the fence post; c) selecting a said fence post from the supply that has a required said lateral cross-section; and d) mounting the selected fence post at the installation site.

According to a fifth aspect of the present invention there is provided a fence-post system comprising a first fence post and a second fence post, the first and second fence posts being formed from similar or identical materials, having similar or identical linear mass densities and having different shapes.

According to a sixth aspect of the invention, there is provided a fence-post system comprising: a first fence post comprising folded metal having a first central web which extends longitudinally along a length of the fence post and includes a double layer of metal, layers of the double layer abutting or substantially abutting each other, and first front and rear flanges which oppose each other and are substantially planar, a first ratio defined by a ratio of a lateral extension of the first front flange away from the first central web to a lateral extension of the first rear flange away from the central web; and a second fence post comprising folded metal having a second central web which extends longitudinally along a length of the fence post and includes a double layer of metal, layers of the double layer abutting or substantially abutting each other, and second front and rear flanges which oppose each other and are substantially planar, a second ratio defined by a ratio of a lateral extension of the second front flange away from the central web to a lateral extension of the second rear flange away from the central web; the first ratio being different to the second ratio.

Fence posts having different front to rear flange widths allows for the provision and/or selection of fence posts which suit different aesthetic or structural requirements.

According to a seventh aspect of the invention, there is provided a fence comprising a fence post of the fence post system according to the first aspect of the invention.

According to an eighth aspect of the invention, there is provided a method of installing a fence according to the seventh aspect of the invention, the method comprising: providing a fence post system according to the first aspect of the invention, selecting a fence post from the fence post system, and installing a fence comprising said fence post.

BRIEF DESCRIPTION OF THE DRAWINGS

The invention will now be more particularly described, by way of example only, with reference to the accompanying drawings, in which.

Figure 1:
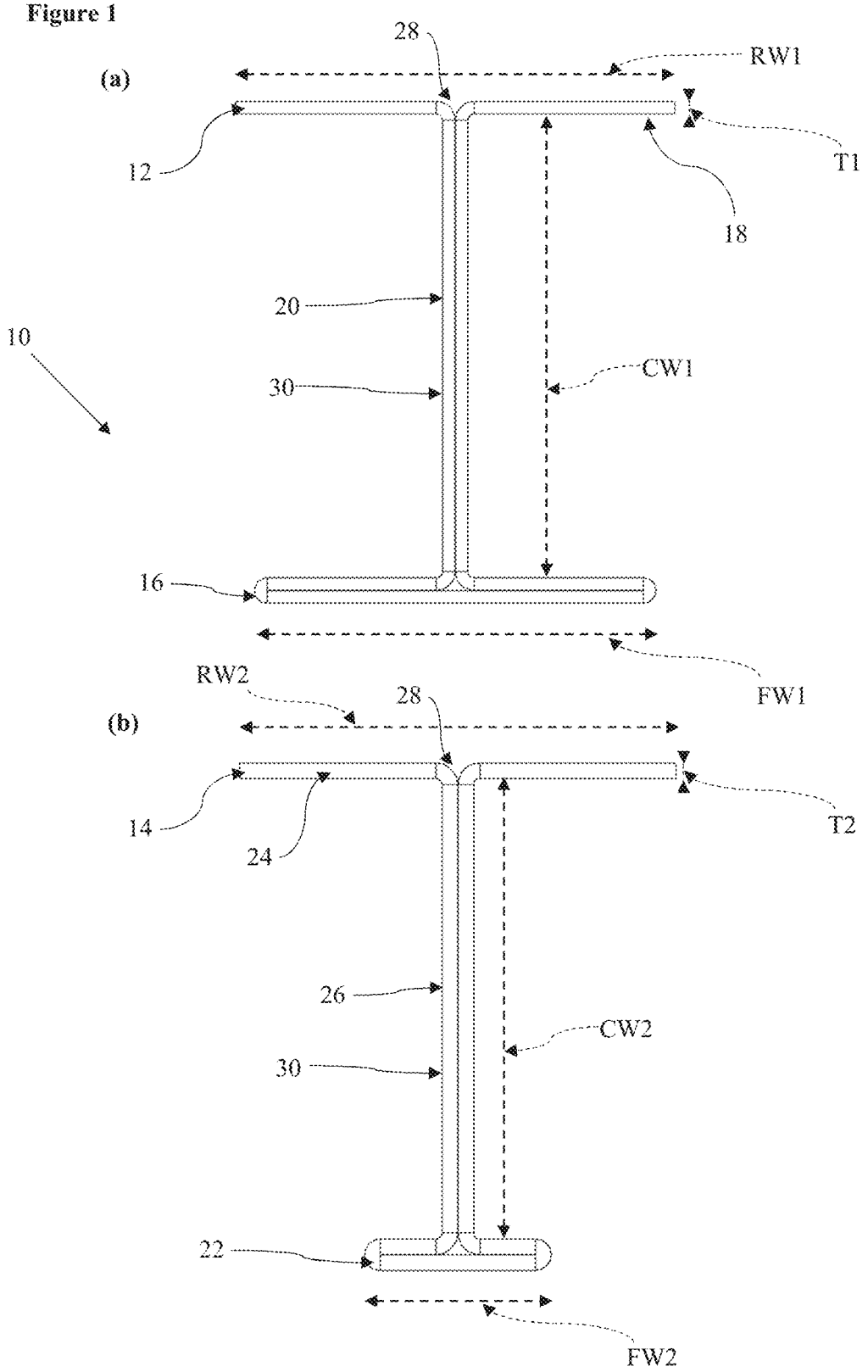
FIGS. 1*a* and 1*b* show a cross-section of a first embodiment of a fence-post system according to first, fifth and sixth aspects of the present invention, comprising first embodiments of a first and second fence post shown respectively in FIGS. 1*a* and 1*b;*

Referring firstly to FIG. 1 there is shown a fence-post system 10 comprising first and second fence posts 12, 14 which have differently shaped cross-sections and similar or identical linear mass densities.

DETAILED DESCRIPTION

The fence posts 12, 14 are each here formed from a sheet of material. The sheet of material is folded or bent to form the shape of each fence post 12, 14. Preferably the material is metal, for example steel, aluminium or titanium, although other materials may be considered such as composite materials. More preferably, the metal is steel and is galvanized for durability and corrosion resistance, stainless steel in particular and non-galvanized metals may also be considered. Whilst the fence posts are formed form the same material, it will be appreciated that the fence posts may be formed from different materials having similar or identical densities.

The shape of each fence post 12, 14 is formed via a rolling process, which is preferably a cold-rolling process. The cold-rolling increases a hardness or a strength of each fence post 12, 14. However, hot-rolling processes may also be considered for cost-effectiveness or increasing a toughness of each fence post 12, 14. Whilst rolling a sheet of material is described, it will be appreciated that other formation methods may be used such as extrusion, casting or forging. In the instance of extrusion or casting, it will be appreciated that the material may not be folded into a fence post.

The first fence post 12 is formed or folded from a sheet having a first thickness T1 and has a first front flange 16 which has a first front width FW1. The first fence post 12 additionally has a first rear flange 18 and preferably a first central web 20 which extends between the front and rear flanges 16, 18. Whilst a central web is described, it will be appreciated that this term may encompass a rib or a wall and/or may not necessarily be required to be defined as "central". Here the web is shown as being continuous; however, it will be appreciated that apertures may extend therethrough.

The second fence post 14 similarly is formed or folded from a sheet having a second thickness T2 and has a second front flange 22 which has a second front width FW2. The second fence post 14 additionally has a second rear flange 24 and preferably a second central web 26 which extends between the front and rear flanges 16, 18.

Here the first front width FW1 is greater than the second front width FW2. In this way, the second fence post 14 is a narrower or slimmer fence post than the first fence post 12. Thus, when installed, the second fence post 14 has a smaller visual impact than the first fence post 12. The smaller second front width FW2 would conventionally result in less material used to form the second fence post 14 than the first fence post 12. To compensate for this, the second fence post 14 is formed form a thicker material such that the second thickness T2 is greater than the first thickness T1 of the first fence post 12. The additional thickness of material of the second fence post 14 corresponds to a similar or identical amount of material as that of the reduction in width of the second front flange 22, as compared to the first front flange 16. Thus, the first and second fence posts 12, 14 have a similar or identical linear mass density. In other words, if the first and second fence posts 12, 14 have similar or identical lengths, then the first and second fence posts 12, 14 have similar or identical weights or masses.

The first and second fence posts 12, 14 are each formed so that lateral edges of the material or metal sheet are at the rear flange 18, 24. The rear flange 18, 24 is planar or substantially planar and comprises a single layer of material which comprises the lateral edge portions of the sheet. At the interengagement of the two lateral edge portions, a channel 28 is formed which extends along each fence post 12, 14, for example along the entire or at least a majority of a longitudinal extent of each fence post 12, 14. The first and second rear flanges 18, 24 have first and second rear widths RW1, RW2 respectively. Here the first and second rear flanges 18, 24 are identical or substantially identical.

Each central web 20, 26 comprises two layers or a double layer of material, each layer extending perpendicularly or substantially perpendicularly from one of the lateral edge portions of the sheet which form the rear flange 18, 24. The two layers of material of each central web 20, 26 preferably abut each other or substantially abut each other. The depth or width of each central web 20, 26, in other words, the separation of the front and rear flanges 16, 18, of the first and second fence posts 12, 14, is similar or identical to that of the other.

The first and second front flanges 16, 22 extend laterally out from the first and second central webs 20, 26 respectively. Preferably, each front flange 16, 22 comprises two layers or a double layer of material. This is preferably such that there are no voids between the two layers. Here a small void may extend along a longitudinal extent of each fence post 12, 14 between the central web and the front flange. Each front flange 16, 22 preferably extends perpendicularly or substantially perpendicularly and planarly or substantially planarly from each central web 20, 26.

The first and second fence posts 12, 14 are H-shaped, substantially H-shaped, I-shaped or substantially I-shaped. Between the front and rear flanges 16, 18 two channels, which are here square bottomed channels 30, are defined. Each channel 30 may be for receiving a fence panel or rail therein.

The first thickness T1 is exemplarily between 1.7 mm and 2.3 mm, for example 2 mm. The width RW1 of the first rear flange 18 is between 60 mm and 80 mm, for example 70 mm. The depth or width CW1 of the first central web 20 is between 50 mm and 100 mm, for example 74 mm. The width FW1 of the first front flange 16 is between 50 mm and 80 mm, for example 64 mm. Taking into account the double layer of the material for the central web and front flange, the cross-sectional area of material of the first fence post 12 is within the range of 650 mm2 to 750 mm2, for example 692 mm2.

The thickness of the material of the second fence post 14 is exemplarily between 2.2 mm and 2.8 mm for example 2.5 mm, provided that the thickness of the material of the second post 14 is greater than that of the first post 12. The width RW2 of the second rear flange 24 is between 60 mm and 80 mm, for example 70 mm. The depth or width CW2 of the second central web 26 is between 50 mm and 100 mm, for example 74 mm. The width FW2 of the second front flange 22 is between 10 mm and 50 mm, for example 30 mm. Taking into account the double layer of the material for the central web and front flange, the cross-sectional area of material of the second fence post 14 is within the range of 650 mm2 to 750 mm2, for example 695 mm2.

Therefore, given that the first and second fence posts 12, 14 are formed from material of similar or identical densities, the linear mass densities are similar or identical. The density of the material, for example steel, used may be between 7000 kg m−3 and 7500 kg m−3, for example being 7300 kg m−3. The linear mass density of the first and second fence posts 12, 14 may therefore be around 5 kg m−1.

The fence posts 12, 14 have a similar or identical length. Here the fence posts 12, 14 have a length of between 2.5 m and 3.5 m, for example 3 m. The weight or mass of the first and second fence posts 12, 14 is preferably therefore also similar or identical, for example being between 12 kg and 18 kg, such as 15 kg or 15.2 kg.

Whilst these exemplary dimensions, densities and resulting mass are provided, it will be appreciated that other dimensions and densities may be used resulting in a different mass.

The first rear width RW1 is preferably greater than or equal to the first front width FW1. Preferably a ratio of the first rear width RW1 to the first front width FW1 is between 1:1 and 1.4:1, for example being 1.1:1. The second rear width RW2 is preferably greater than or equal to the second front width FW2. Preferably, a ratio of the second rear width RW2 to the second front width FW2 is between 2.4:1 and 2.8:1, for example being around 2.5:1. Thus two different fence posts 12, 14 with two different ratios of rear to front flange width are provided.

Figure 2:
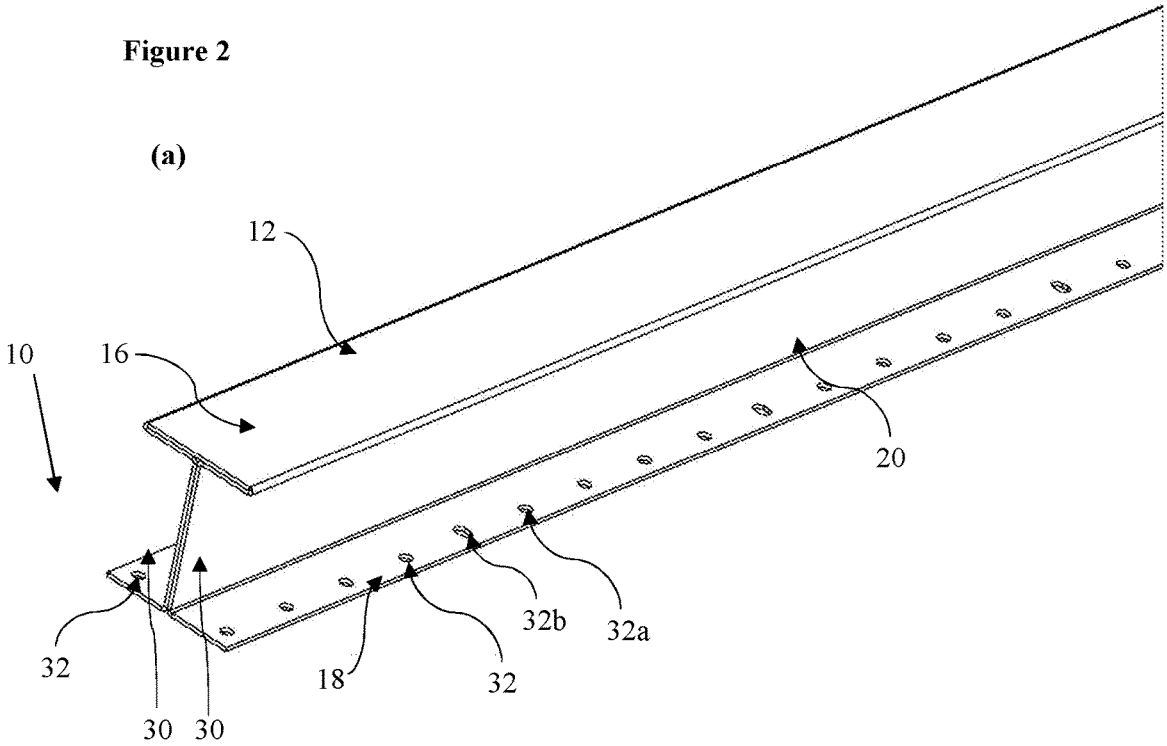
FIGS. 2*a* and 2*b* show a perspective view of an in use upper portion of the fence posts of FIGS. 1*a* and 1*b* respectively.
Figure 2:
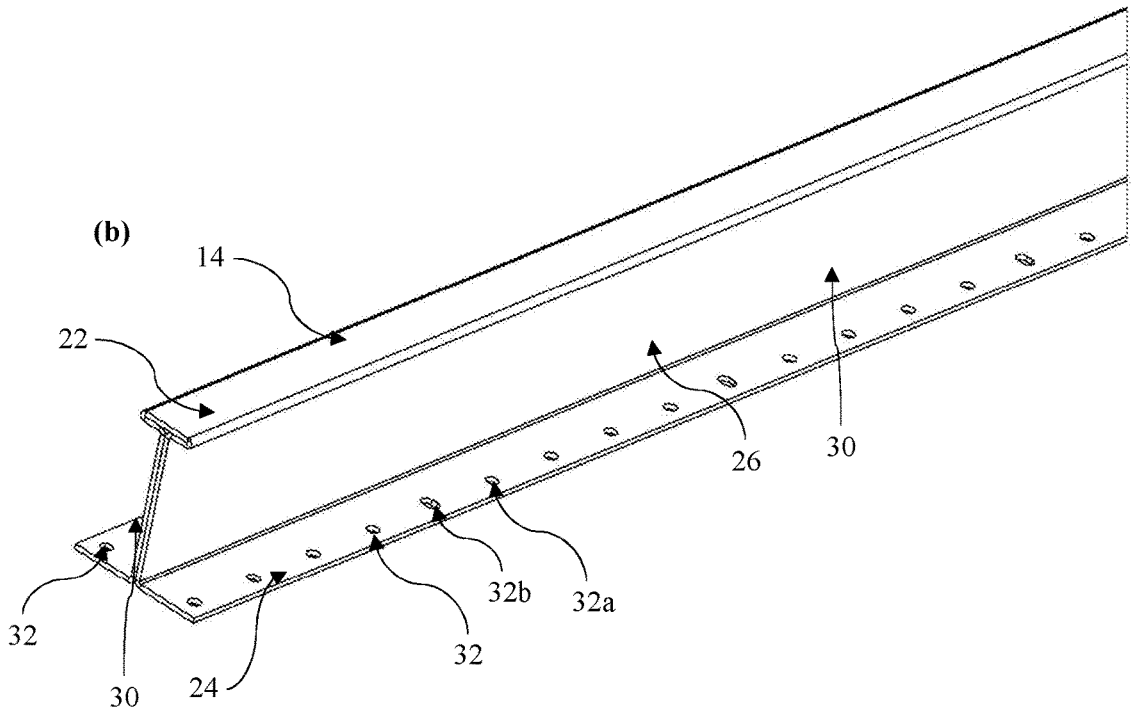
Figure 3:
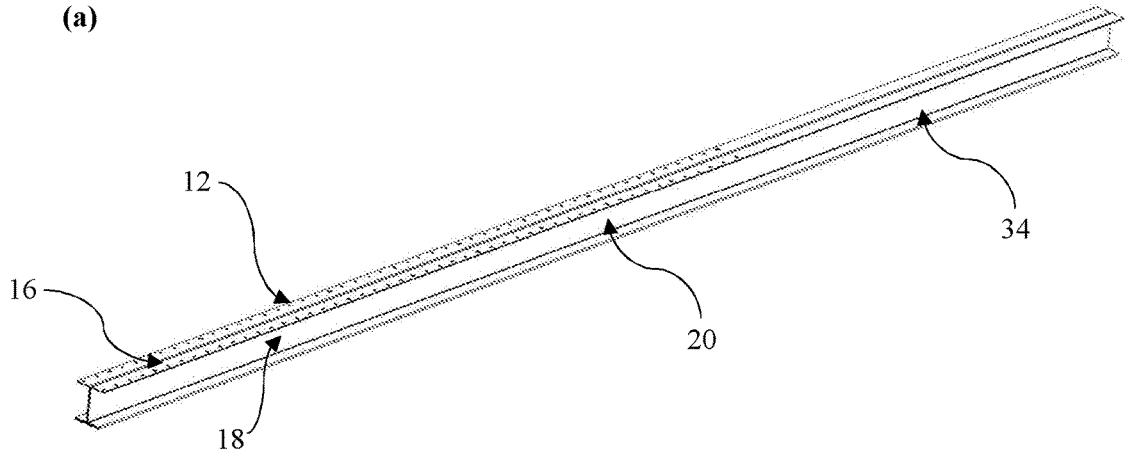
FIGS. 3*a* and 3*b* show a perspective view of the fence posts of FIGS. 1*a* and 1*b* respectively.
Figure 3:
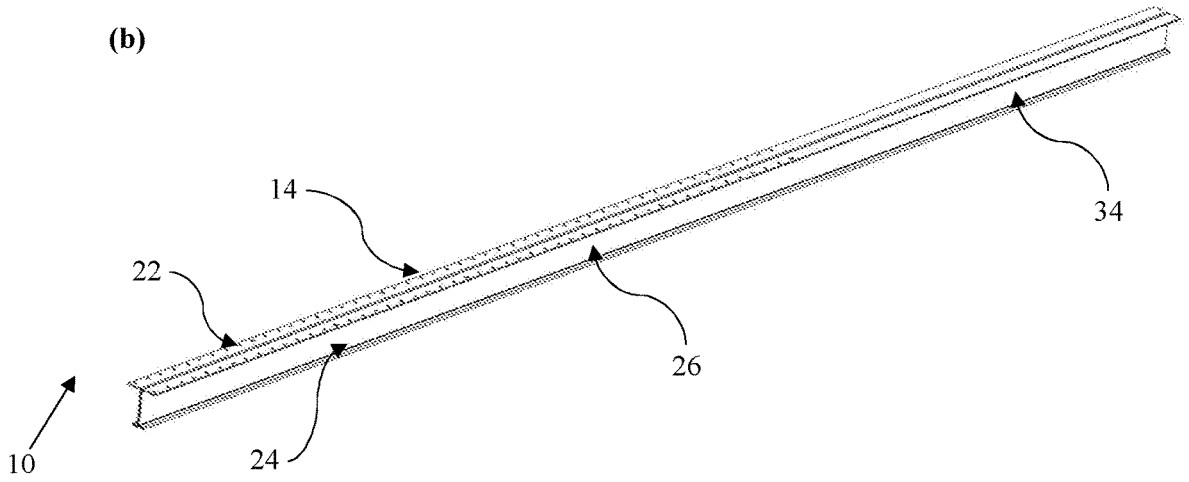

Referring now to FIGS. 2 and 3, the rear flange 18, 24 preferably has a plurality of fastener receiving apertures 32 therethrough. The fastener receiving apertures 32 are for receiving fasteners which attach fence panels to the posts. Here the fastener receiving apertures 32 are linearly arranged and extend along at least a majority of the longitudinal extent of each fence post 12, 14. The fastener receiving apertures 32 are not required to extend along the entire length of each fence post 12, 14 as a lower portion 34 of each fence post 12, 14 is typically received below ground, such as in concrete, during installation. Here, the fastener receiving apertures 32 extend along approximately 60% of each fence post 12, 14. However, it will be appreciated that fastener receiving apertures may extend along other proportions of the fence post, for example between 51% and 90%, although fastener receiving apertures along the entire length may also be considered. There are here two, preferably matching, lines of fastener receiving apertures 32, each line in one lateral edge portion of each fence post 12, 14. Each line is preferably spaced from the central web by the same distance.

The fastener receiving apertures 32 comprise two different types of apertures; a circular hole 32*a* and a laterally elongate slot 32*b*, although a vertically elongate slot may also be considered for providing flexibility in the vertical positioning of the fasteners. The adjacent elongate slots 32*b* are preferably separated by circular holes 32*a*, for example there are four circular holes 32*a* which separate adjacent slots 32*b*. Adjacent fastener receiving apertures 32 may have a spacing of between 30 mm and 50 mm, for example 38 mm.

In use, the first and second fence posts 12, 14 may be formed from an initially planar sheet of metal via a cold roll forming process. Each bend in each fence post 12, 14 may be formed via one or more rollers engaging the sheet of metal. The first fence post 12 may be formed from a thinner and wider initial sheet of metal than the second fence post 14. However, the first and second fence posts 12, 14 may be formed from sheets of metal having the same dimensions of metal with thinning of the first fence post 12 occurring during the cold-rolling process. The cold-rolling process is preferably a continuous process and multiple fence posts maybe formed from the same sheet of metal. The first and second fence posts 12, 14 are each formed from a section of metal sheet of a similar or identical weight.

The fence post system 10 may therefore be formed by selecting a first and second sheet of metal having first and second thicknesses T1, T2 respectively and having first and second sheet widths respectively. The first sheet width may be equal or equivalent to the sum of the rear width RW1, twice the front width FW1 and twice the central web depth CW1 of the first fence post 12. Similarly, the second sheet width may be equal or equivalent to the sum of the rear width RW2, twice the front width FW2 and twice the central web depth CW2 of the second fence post 14.

The first and second sheets may then be formed into the first and second fence posts respectively. The sheets may be roll-formed into the appropriate cross-section. Should the length of each sheet be greater than or a multiple of the length of the fence posts, the sheets may be cut to size.

A first or second fence post 12, 14 may then be selected depending on structural, aesthetic or situational requirements. For example, if the fence post is to be installed in a fence where minimization of the visual impact of the fence post is important, the second fence post 14 with a narrower front flange and a greater rear width to front width ratio may be selected. A wider rear flange 24 maintains a suitable or adequate force of attachment between the fence post 14 and the panel. However, if strength of attachment between the fence post 14 and the fence panel is of significant importance, for example if the fence is required to withstand very high windspeeds, then the first fence panel may be selected. The wider front flange 22 ensures a stronger force of attachment with the fence panel.

If required to be installed on the same site, the first and second fence posts 12, 14 may be transported to a given site. Given their identical or similar weights, arrangement of the transportation of the posts 12, 14 is simplified. The first and second fence posts 12, 14 may then be maneuvered to the installation position. Given their similar or identical weights, lifting provisions for the fence posts 12, 14 are simplified.

The first and second fence posts 12, 14 may be installed via excavating a hole in the ground, positioning a lower end portion 34 of the fence post 12, 14 in the hole and filling the hole with concrete. The fence panels can then be attached to the fence post 12, 14 by inserting an edge of the fence panel into the channel 30 and inserting fasteners through the fastener receiving apertures 32 which fixes the panels to the fence post. Whilst panels are described, it will be appreciated that rails may be considered.

Figure 4:
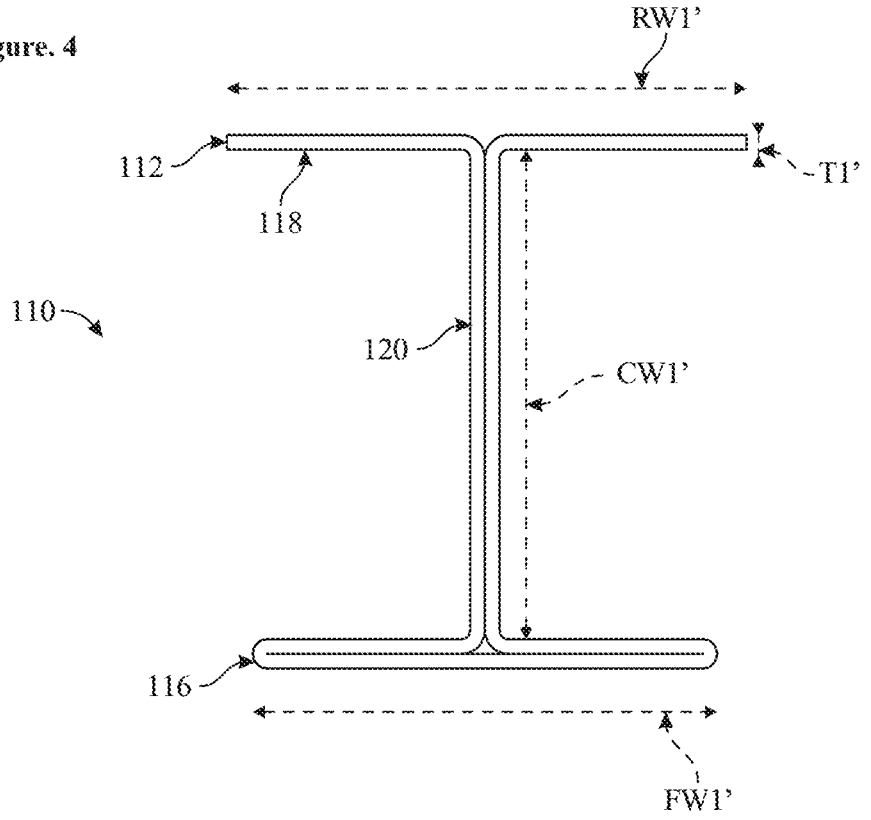
FIGS. 4*a* and 4*b* show a cross-section of a second embodiment of a fence-post system according to first, fifth and sixth aspects of the present invention, comprising second embodiments of a first and second fence posts shown respectively in FIGS. 1*a* and 1*b*.
Figure 4:
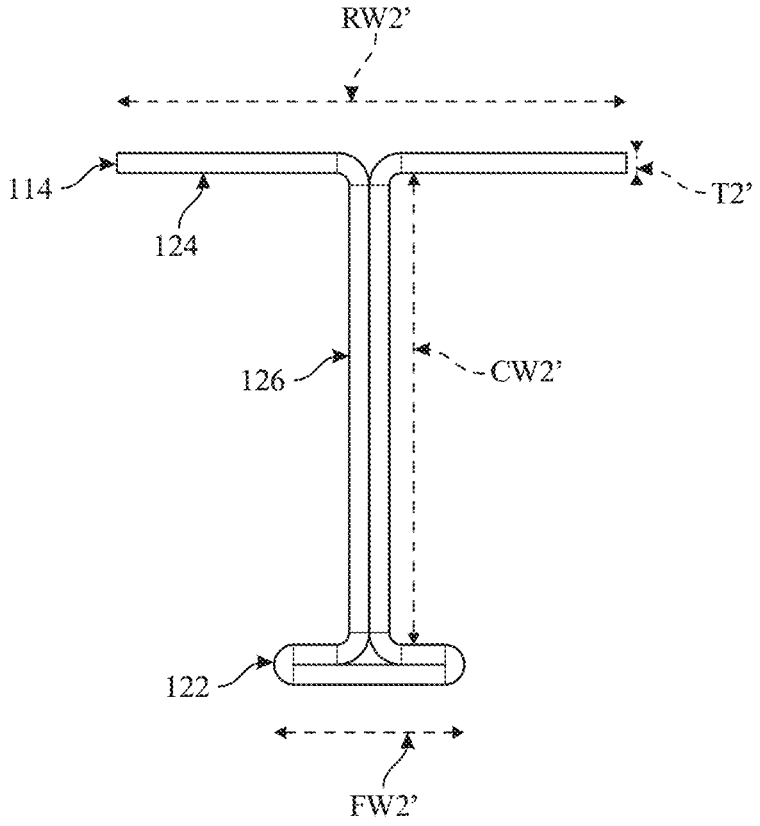

Referring now to FIG. 4, there is shown a second embodiment of the fence-post system 110 comprising second embodiments of first and second fence posts 112, 114. The second embodiments of the first and second fence posts 112, 114 may be similar or identical to the first embodiments of the first and second fence posts 112, 114, with the exception that the dimensions are different. Similar or identical reference numerals are used for the second embodiment as for the first embodiment with 100 added.

The first fence post 112 has a first front flange 116 with a first front width FW1' which is greater than a second front width FW2' of the second front flange 122 of the second fence post 114. The first fence post 112 is formed from a first thickness T1' of metal which is thinner than a second thickness T2' of metal which the second fence post 114 is formed from.

The first thickness T1' is between 1.2 mm and 1.8 mm, for example 1.5 mm. The first front width FW1' of a front flange 116 is between 40 mm and 60 mm, for example being 48 mm. A first rear width RW1' of a rear flange 118 of the first fence post 112 is between 40 mm and 60 mm, for example being 54 mm. A central web width or depth CW1' of a first central web 120 of the first fence post 112 is between 40 mm and 60 mm, for example being 50 mm. A cross-sectional area of the first fence post 112 is therefore between 350 mm2 and 400 mm2, in particular 375 mm2.

The second thickness T2' is between 1.7 mm and 2.3 mm, for example 2 mm. The second front width FW2' of a front flange 122 is between 10 mm and 30 mm, for example 20 mm. A second rear width RW2' of a rear flange 124 of a second fence post 114 is between 40 mm and 60 mm, for example being 54 mm. A central web width CW2' or depth of a second central web 126 of the second fence post 114 is between 40 mm and 60 mm, for example being 50 mm. A cross-sectional area of the second fence post 114 is therefore between 350 mm2 and 400 mm2, in particular 375 mm2.

Thus, the cross-sectional areas of the second embodiments of the first and second fence posts 112, 114 are similar or identical. Therefore, given that the first and second fence posts 112, 114 are formed from material of similar or identical densities, the linear mass densities are similar or identical. The density of the material, for example steel, used may be between 7000 kg $m^{-3}$ and 7500 kg $m^{-3}$, for example being 7300 kg $m^{-3}$. The linear mass density of the first and second fence posts 112, 114 may therefore be around 2.8 kg $m^{-1}$.

The fence posts 112, 114 have a similar or identical length. Here the fence posts 112, 114 have a length of between 2 m and 3 m, for example 2.5 m or 2.4 m. The weight or mass of the first and second fence posts 112, 114 is preferably therefore also similar or identical, for example being between 5 kg and 9 kg, such as 7 kg.

Preferably, a ratio of the first rear width RW1' to the first front width FW1' is between 1:1 and 1.4:1, for example being 1.1:1. The first rear width RW1' is preferably greater than or equal to the first front width FW1'. Preferably, a ratio of the second rear width RW2' to the second front width FW2' is between 2.4:1 and 2.8:1, for example being around 2.7:1. Thus two different fence posts 112, 114 with two different ratios of rear to front flange width are provided.

Figure 5:
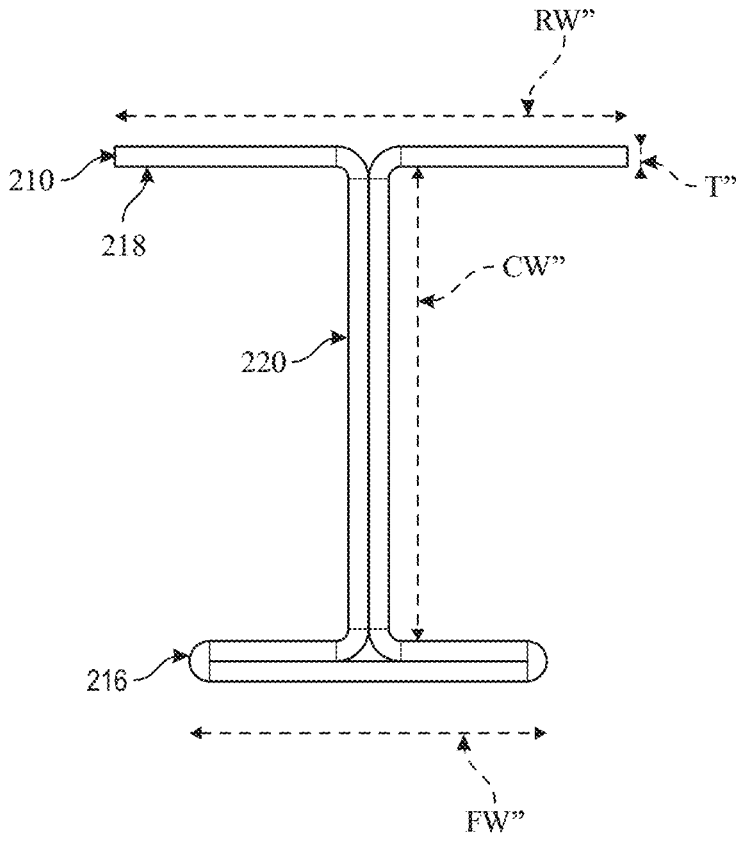
FIG. 5 shows a further fence post suitable for use with a fence post system according to the first, fifth and sixth aspects of the present invention.

Referring now to FIG. 5, there is shown a further fence post 210. The further fence post 210 is preferably similar or identical to the preceding fence posts with the exception of having different dimensions. Similar or identical reference numerals are used as compared to the initial embodiment, with 200 added.

The thickness T" of the sheet which forms the further fence post 210 is between 2.5 mm and 3.5 mm, for example 3 mm. A front width FW" of a front flange 216 is between 50 mm and 100 mm, for example being 76 mm. A rear width RW" of a rear flange 218 of the further fence post 210 is between 70 mm and 130 mm, for example being 100 mm. A central web width CW" or depth of a central web 220 the further fence post 210 is between 100 mm and 150 mm, for example being 125 mm. A cross-sectional area of the further fence post 210 is therefore around 1500 mm2, in particular 1506 mm2.

The density of the material, for example steel, used may be between 7000 kg m−3 and 7500 kg m−3, for example being 7300 kg m−3. The linear mass density of the further fence post 210 may therefore be around 11 kg m−1. The length of the further fence post 210 may for example be 2 m. Thus, the weight of the further fence post 210 may be 22 kg.

A rear flange width RW" to front flange width FW" ratio is preferably between 1.1:1 and 1.5:1, for example being 1.3:1.

Whilst the fence-post systems are described as having fence posts of different front to rear flange ratios but the same weight, it will be appreciated that the fence posts may not necessarily have the same weight. For example, the fence posts may have the same material thicknesses. However, a system of different fence post types with different front to rear flange ratios may allow for a user to select between fence post types to suit specific requirements.

It is therefore possible to provide a fence-post system which has a plurality of fence posts with different front to rear flange ratios. A fence post with a most suitable front to rear flange ratio may therefore be selected depending on requirements. Preferably, the fence posts of a given system are identical with the exceptions of front flanges having different widths and a thickness of material from which the fence post is formed. More preferably the difference in thickness and the difference in width of the front flange results in the fence posts being formed from a similar or identical amount of material and having a similar or identical mass or weight. This may be beneficial for manufacturing, transportation and installation.

The words 'comprises/comprising' and the words 'having/including' when used herein with reference to the present invention are used to specify the presence of stated features, integers, steps or components, but do not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The embodiments described above are provided by way of examples only, and various other modifications will be apparent to persons skilled in the field without departing from the scope of the invention as defined herein.

The invention claimed is:

1. A fence-post system comprising:

a first fence post including a first front flange having a first front width and a first rear flange, the first fence post formed from a first folded sheet, the first folded sheet having a first thickness of a first material; and a second fence post including a second front flange having a second front width and a second rear flange, the second fence post formed from a second folded sheet, the second folded sheet having a second thickness of a second material, wherein the first and second materials have one of a similar and identical density, the first front width is greater than the second front width, and the second thickness is greater than the first thickness such that a linear mass density of the first and second fence posts is one of the same and substantially the same.

2. The fence-post system as claimed in claim 1, wherein said first thickness is between 1.2 mm and 1.8 mm and said second thickness is between 1.7 mm and 2.3 mm provided that the second thickness is greater than the first thickness.

3. The fence-post system as claimed in claim 1, wherein said first thickness is between 1.7 mm and 2.3 mm and said second thickness is between 2.2 mm and 2.8 mm provided that the second thickness is greater than the first thickness.

4. The fence-post system as claimed in claim 1, wherein the first front width is between 50 mm and 80 mm and the second front width is between 10 mm and 50 mm.

5. The fence-post system as claimed in claim 1, wherein the first front width is between 40 mm and 60 mm and the second front width is between 10 mm and 30 mm.

6. The fence-post system as claimed in claim 1, wherein a plurality of fastener-receiving apertures extends through at least one of the first front and rear flanges and at least one of the second front and rear flanges.

7. The fence-post system as claimed in claim 1, wherein the first rear flange has a first rear width and the second rear flange has a second rear width, the first and second front widths being less than the first and second rear widths, respectively.

8. The fence-post system as claimed in claim 7, wherein the first and second rear widths are similar or identical to each other.

9. The fence-post system as claimed in claim 7, wherein a first ratio of the first rear width to the first front width is between 1:1 and 1.4:1, and a second ratio of the second rear width to the second front width is between 2.4:1 and 2.8:1.

10. The fence-post system as claimed in claim 1, wherein the first fence post further comprises a first central web which extends between the first rear flange and the first front flange, the first central web comprising two layers of material and one of the first rear flange and the first front flange comprising two layers of material, and the second fence post further comprises a second central web which extends between the second rear flange and the second front flange, the second central web comprising two layers of material and one of the second rear flange and the second front flange comprising two layers of material.

11. The fence-post system as claimed in claim 10, wherein:

the two layers of material of the first central web abut each other, the two layers of material of said one of the first rear flange and the first front flange abut each other, the two layers of material of the second central web abut each other, and the two layers of material of said one of the second rear flange and the second front flange abut each other.

12. The fence-post system as claimed in claim 10, wherein the first and second front flanges are double layered and the first and second rear flanges are single layered.

13. The fence-post system as claimed in claim 1, wherein the first and second material is steel.

14. The fence-post system as claimed in claim 1, wherein the first and second fence posts have one of similar and identical lengths.

15. The fence-post system as claimed claim 1, wherein a length of the first and second fence posts is between 2.5 m and 3.5 m and a mass of each of the first and second fence posts is between 12 kg and 18 kg.

16. The fence-post system as claimed in claim 1, wherein a length of the first and second fence posts is between 2 m and 3 m and a mass of each of the first and second fence posts is between 5 kg and 9 kg.

17. The fence-post system as claimed in claim 1, wherein:

the first fence post is formed from a single folded sheet that is the first folded sheet, and the second fence post is formed from a single folded sheet that is the second folded sheet.

18. A method of forming the fence-post system as claimed in claim 1, the method comprising:

selecting a first sheet of the first material having the first thickness and a first sheet width, and a second sheet of the second material having the second thickness and a second sheet width, the first and second materials having one of similar and identical densities, the first sheet width being greater than the second sheet width, and the second thickness being greater than the first thickness such that a linear mass density of the first and second sheets is one of the same and substantially the same; and folding the first and second sheets into the first and second fence posts respectively, the first fence post including the first front flange having the first front width and the first rear flange and the second fence post including the second front flange having the second front width and the second rear flange.

19. A method of conforming, handling and/or transporting weight for the first and second fence posts with different lateral cross-sections using the fence-post system as claimed in claim 1, the method comprising the step of forming the first and second fence posts from one of similar and identical materials, the first and second fence posts having one of similar and identical linear mass densities and different cross-sections.

* * * * *